US007681738B2

(12) United States Patent
Lean et al.

(10) Patent No.: US 7,681,738 B2
(45) Date of Patent: Mar. 23, 2010

(54) TRAVELING WAVE ARRAYS, SEPARATION METHODS, AND PURIFICATION CELLS

(75) Inventors: Meng H. Lean, Santa Clara, CA (US); Jeng Ping Lu, San Jose, CA (US); Scott J. Limb, Palo Alto, CA (US); Jürgen H. Daniel, Mountain View, CA (US); Armin R. Völkel, Mountain View, CA (US); Huangpin Ben Hsieh, Mountain View, CA (US); Scott E. Solberg, Mountain View, CA (US); Bryan T. Preas, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1125 days.

(21) Appl. No.: 11/224,347

(22) Filed: Sep. 12, 2005

(65) Prior Publication Data

US 2007/0057748 A1 Mar. 15, 2007

(51) Int. Cl.
*B03B 5/00* (2006.01)

(52) U.S. Cl. ..... 209/461; 209/458; 209/460; 209/155; 209/485; 209/477

(58) Field of Classification Search ..... 209/456, 209/458, 460, 461, 474, 477, 485, 482, 422
See application file for complete search history.

(56) References Cited

U.S. PATENT DOCUMENTS

| | | | |
|---|---|---|---|
| 3,449,938 | A | 6/1969 | Giddings |
| 4,147,621 | A | 4/1979 | Giddings |
| 4,214,981 | A | 7/1980 | Giddings |
| 4,250,026 | A | 2/1981 | Giddings et al. |
| 4,440,638 | A | 4/1984 | Judy et al. |
| 4,527,884 | A | 7/1985 | Nusser |
| 4,558,941 | A | 12/1985 | Nosaki et al. |
| 4,647,179 | A | 3/1987 | Schmidlin |
| 4,896,174 | A | 1/1990 | Stearns |
| 5,039,426 | A | 8/1991 | Giddings |
| 5,133,844 | A | 7/1992 | Stevens |
| 5,156,039 | A | 10/1992 | Giddings |
| 5,160,625 | A | 11/1992 | Jonsson et al. |
| 5,281,982 | A | 1/1994 | Mosehauer et al. |
| 5,400,062 | A | 3/1995 | Salmon |
| 5,454,945 | A | 10/1995 | Spearman |
| 5,632,957 | A | 5/1997 | Heller et al. |
| 5,717,986 | A | 2/1998 | Vo et al. |
| 5,850,587 | A | 12/1998 | Schmidlin |
| 5,893,015 | A | 4/1999 | Mojarradi et al. |
| 6,070,036 | A | 5/2000 | Thompson et al. |

(Continued)

OTHER PUBLICATIONS

Giddings, "Field-Flow Fractionation: Analysis of Macromolecular Colloidal, and Particulate Materials," Science, vol. 260, pp. 1456-1465, (1993).

*Primary Examiner*—Patrick H Mackey
*Assistant Examiner*—Terrell H Matthews
(74) *Attorney, Agent, or Firm*—Fay Sharpe LLP

(57) ABSTRACT

Various traveling wave grid configurations are disclosed. The grids and systems are well suited for transporting, separating, and classifying small particles dispersed in liquid or gaseous media. Also disclosed are various separation strategies and purification cells utilizing such traveling wave arrays and strategies.

22 Claims, 6 Drawing Sheets

U.S. PATENT DOCUMENTS 6,112,044 A 8/2000 Thompson et al.
6,116,718 A 9/2000 Peeters et al.
6,134,412 A 10/2000 Thompson
6,136,171 A 10/2000 Frazier et al.
6,137,979 A 10/2000 Garstein et al.
6,180,956 B1 1/2001 Chondroudis et al.
6,192,764 B1 2/2001 Jiang et al.
6,219,515 B1 4/2001 Lestrange
6,246,855 B1 6/2001 Gartstein et al.
6,272,296 B1 8/2001 Gartstein
6,287,832 B1 9/2001 Becker et al.
6,290,342 B1 9/2001 Vo et al.
6,293,659 B1 9/2001 Floyd et al.
6,328,409 B1 12/2001 Peeters et al.
6,340,216 B1 1/2002 Peeters et al.
6,351,623 B1 2/2002 Thayer et al.
6,355,491 B1 3/2002 Zhou et al.
6,416,158 B1 7/2002 Floyd et al.
6,416,159 B1 7/2002 Floyd et al.
6,439,711 B1 8/2002 Carlini et al.
6,454,384 B1 9/2002 Peeters et al.
6,467,862 B1 10/2002 Peeters et al.
6,467,871 B1 10/2002 Moffat et al.
6,499,831 B2 12/2002 Schmidlin
6,511,149 B1 1/2003 Peeters et al.
6,521,297 B2 2/2003 McDougall et al.
6,523,928 B2 2/2003 Peeters et al.
6,598,954 B1 7/2003 Moffat et al.
6,692,627 B1 2/2004 Russell et al.
6,719,399 B2 4/2004 Moffat et al.
6,751,865 B1 6/2004 Peeters et al.
7,156,970 B2 * 1/2007 Lean et al. ..... 204/547
7,309,410 B2 * 12/2007 Lean et al. ..... 204/643
7,374,603 B2 * 5/2008 Biegelsen ..... 96/26
2004/0000519 A1 1/2004 Jiang et al.
2005/0247564 A1 * 11/2005 Volkel et al. ..... 204/600
2007/0057748 A1 * 3/2007 Lean et al. ..... 333/157
2007/0175801 A1 * 8/2007 Lean et al. ..... 209/127.1

* cited by examiner

TRAVELING WAVE ARRAYS, SEPARATION METHODS, AND PURIFICATION CELLS

STATEMENT REGARDING FEDERALLY SPONSORED RESEARCH OR DEVELOPMENT

This invention was made with Government support under W911NF-05-C-0075 awarded by the U.S. Army. The Government has certain rights in this invention.

BACKGROUND

The present exemplary embodiment relates to instruments or devices for collecting and sorting particles or samples, particularly from liquid or gaseous media. The exemplary embodiment finds particular application in conjunction with the separation and detection of biological agents, and will be described with particular reference thereto. However, it is to be appreciated that the present exemplary embodiment is also amenable to other like applications.

Bio-agents dispersed either in aerosol form or in water are typically in such low concentrations that they are below the limit of detection (LOD) of even the most sensitive detection schemes. Yet, the ingestion of even a single bacterium may lead to fatal consequences. Accordingly, regardless of whether the sample is derived from aerosol or water collection, there exists a need to further concentrate the sample prior to detection.

Aerosol and hydrosol collection schemes typically sample large volumes of air at very high rates (150 kL/min and up), and use a cyclone-impactor design to collect particles having a size in the threat range and capture them in a wet sample of 5-10 mL volume. This supernatant is then used as the test sample for agent detection. In order to use currently available detection strategies, it would be desirable to further concentrate the hydrosol by another two orders of magnitude. For example, this could be achieved by collecting all the bio-particles in the sample volume within a smaller volume of 50-100 μL.

Contaminants in water are typically treated by several filtration steps to recover the sample for agent testing. After initial pre-filtration to remove larger vegetative matter, the sample is further concentrated by two to three orders of magnitude using ultra-filtration. This method of tangential flow filtration (TFF) is laborious as it may require multiple sequential steps of TFF; each step utilizing a filter of molecular weight (MW) cut-off that is 3-6× lower than the MW of the target molecules, and recycling of the retentate. The limiting factor for TFF is system loss, where there is a cut-off below which it may not provide any further improvement in concentration. The retentate at the end is approximately a 50 mL volume to be presented to the detector. It would be particularly desirable to further concentrate the retentate by up to another three orders of magnitude.

Field Flow Fractionation (FFF) is a technique that allows the separation of particles of different charge to size ratios (q/d) in a flow channel. This technique is useful in many fields ranging from printing to biomedical and biochemical applications. Separation is achieved because particles with different q/d ratios require different times to move across the flow channel, and therefore travel different distances along the flow channel before arriving at a collection wall. To obtain well-defined and separated bands of species with different q/d values, the particles are typically injected through a narrow inlet from the top of the channel. Total throughput depends on the inlet geometry and flow rate, which in turn affects the q/d resolution of the system.

FFF relies upon the presence of a field perpendicular to the direction of separation to control the migration of particles injected into a flow field. The separated components are eluted one at a time out of the system based on retention times, and are collected in a sequential manner. The separations are performed in a low viscosity liquid, typically an aqueous buffer solution, which is pumped through the separation channel and develops a parabolic velocity profile typical of Poissieulle flow. The process depends on controlling the relative velocity of injected particles by adjusting their spacing from the side walls. Particles with higher electrophoretic mobility or zeta potential will pack closer to the walls and therefore move slower than those that are nearer the center of the channel. In effect, particles move at different rates through the system based on zeta potential and size. Use of different separation mechanisms such as thermal, magnetic, dielectrophoretic, centrifugation, sedimentation, steric, and orthogonal flow has given rise to a family of FFF methods. Although satisfactory in many respects, there remains a need for an improved FFF separation technique.

The present exemplary embodiment contemplates a new and improved system, device, cells, and related methods which overcome the above-referenced problems and others.

INCORPORATION BY REFERENCE

U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference.

BRIEF DESCRIPTION

In a first aspect, the exemplary embodiment provides a traveling wave grid system comprising a first traveling wave grid, a second traveling wave grid downstream of the first wave grid, and a transition region extending between the first and second traveling wave grids. The transition region includes a collection of arcuate traces. The transition region is adapted to transport and cause convergence of a particle stream from the first grid to the second grid.

In another aspect, the exemplary embodiment provides a method for differentiating and optionally collecting particles according to size from a sample of particles. The method comprises providing a traveling wave grid system including a first traveling wave grid and a second traveling wave grid. The first and second traveling wave grids are oriented at an angle with respect to each other. The angle ranges from about 10° to about 170°. The method comprises introducing a sample containing particles of different sizes onto the first traveling wave grid. The method further comprises operating the traveling wave grid system to thereby transport the particles along the first and second traveling wave grids. Upon undergoing a change in direction corresponding to the angled orientation of the first and second traveling wave grids, the particles separate into at least two groups according to size of the particles.

In yet a further aspect, the exemplary embodiment provides a method for differentiating and optionally collecting particles according to size from a sample of particles. The method comprises providing a traveling wave grid including a provision for selectively adjusting a sweep frequency of an electrical voltage signal applied to the grid. The method also comprises introducing a sample containing particles of different sizes on the traveling wave grid. The method further comprises operating the grid at a first sweep frequency whereby particles of a first size are displaced from one region of the grid to another. And, the method comprises, operating the grid at a second sweep frequency different than the first sweep frequency whereby particles of a second size, different than the first size, are displaced from one region of the grid to another.

In a further aspect, the exemplary embodiment provides a purification cell adapted to remove and classify particles from a sample. The cell comprises a concentration chamber including a first traveling wave grid, a separation chamber including a second traveling wave grid, and a focusing channel extending between the first and second traveling wave grids. The focusing channel includes a third traveling wave grid. The second and third traveling wave grids are oriented at an angle of from about 10° to about 170° with respect to each other. The separation chamber further includes a collection of compartments adapted to receive particles of different sizes. The collection of compartments are aligned across the second traveling wave grid.

DETAILED DESCRIPTION

Figure 1:
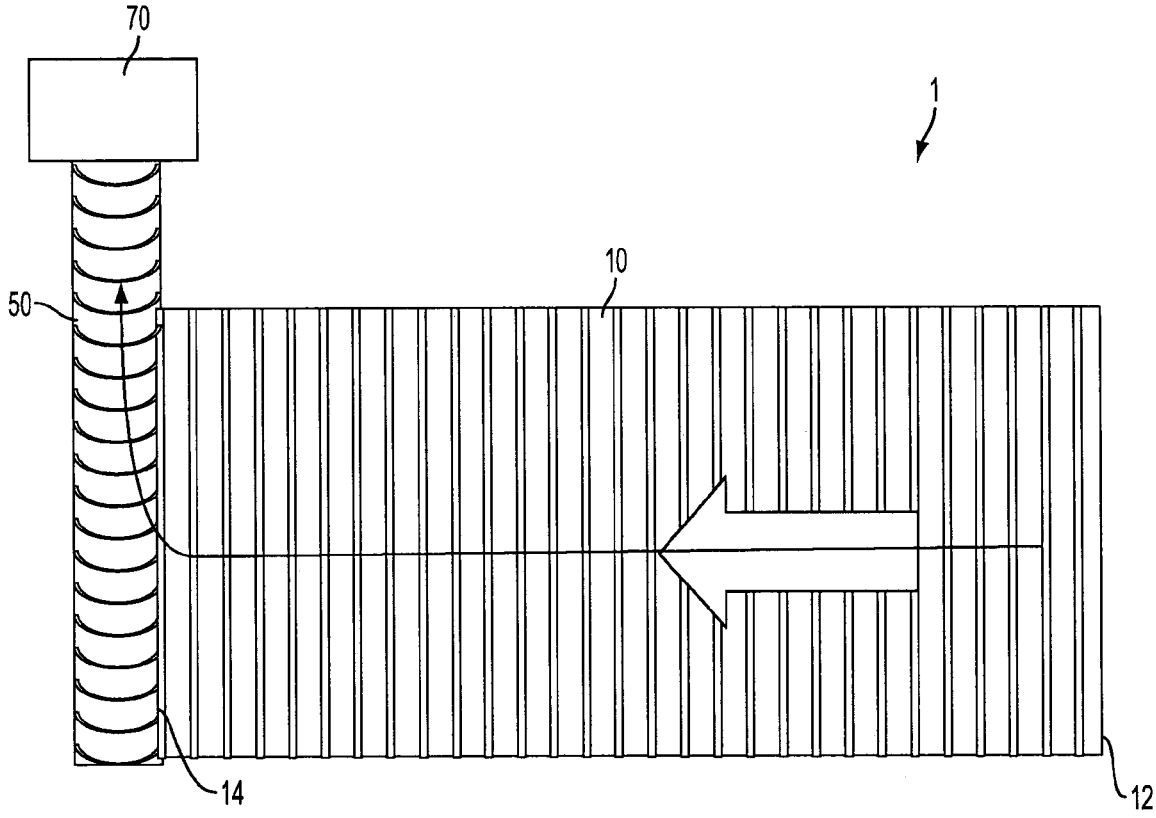
FIG. 1 is a schematic of a traveling wave array that concentrates and directs a stream of particulates to a desired location.

Currently there are no other effective methods to concentrate very dilume amounts of bio agents (or bio molecules) in a liquid sample beyond the typical concentrations achieved by centrifugation and ultrafiltration. Centrifugation at high speed (10,000 rpm) may be used to pellet out large numbers of particles such as bacteria; however, it is not readily portable. The exemplary embodiment device is able to process the retentate after ultrafiltration and provide further concentration by a factor of a hundred or greater. In addition, few devices are available that can handle the volume typically associated with purification or bio-enrichment operations. Lab-on-chip (LOC) devices may handle only minute volumes. The exemplary embodiment device can readily handle such large volumes More specifically, the exemplary embodiment provides various unique traveling wave array configurations that can be utilized to optimize device operation and specifically, to maximize mass transport and to minimize congestion. The exemplary embodiment also provides various methods for sample separation in a liquid medium. And, the exemplary embodiment provides purification cells utilizing cascaded traveling wave grids that provide functions of concentration, focusing, and separation.

The term "traveling wave grid" or "traveling wave array" as used herein, collectively refers to a substrate, a plurality of electrodes to which a voltage waveform is applied to generate the traveling wave(s), and one or more busses, vias, and electrical contact pads to distribute the electrical signals (or voltage potentials) throughout the grid. The term also collectively refers to one or more sources of electrical power, which provides the multi-phase electrical signal for operating the grid. The traveling wave grids may be in nearly any form, such as for example a flat planar form, or a non-planar form. The non-planar form can be, for example, in the form of an arcuate region extending along the outer wall of a cylinder. The non-planar grid could be in the form of an annular grid defined within an interior region of a tube. Traveling wave grids, their use, and manufacture are generally described in the previously noted U.S. patents.

As referred to herein, the various exemplary embodiment traveling wave grid systems comprise one or more chevron grids. The term "chevron" as used herein refers to a pattern of electrodes or traces constituting the traveling wave grid or portion thereof, in which a significant portion of the traces, and typically all traces, are arcuate and also arranged in a concentric fashion. Typically, the arcuate traces are also arranged such that they are defined about one or more center points that are located upstream from the intended direction of particle flow during operation of the collection of traces. This configuration, relative to the direction of flow, serves to maintain direction of the stream and reduce dispersion of particulates in the flowing stream.

Another aspect of the traveling wave grid or array system described herein is that the grids are in certain applications, oriented at some angle with respect to each other. This orientation aspect is actually with regard to the intended (or actual) direction of travel of particulates on one grid relative to the direction of travel of particulates on another grid. Generally, the angle between adjacent grids or regions of grids can be from about 10° to about 170°, more particularly from about 45° to about 135°, and often about 90°. In certain applications, the exemplary embodiment utilizes the directional change of particle flow streams to differentiate, separate, and/or classify the particles.

A traveling wave array can comprise adjacent rectilinear and chevron grids 10 and 50, respectively as shown in FIG. 1. The rectilinear grid 10 transports particulates laterally from a first edge 12 to a second edge 14 where the chevron grid 50 induces a directional turn to move the particulates into a sample well 70 where field extraction can be used to collect the particulates thus increasing their concentration. The chevron grid 50 also serves to focus the resulting particle stream as the stream, when disposed on the chevron grid 50, tends to move at right angles to the direction of the stream on grid 10. The width of the present embodiment chevron grid 50 is about 3 mm and is easily congested when sample concentration exceeds 40 mg/L.

Figure 2:
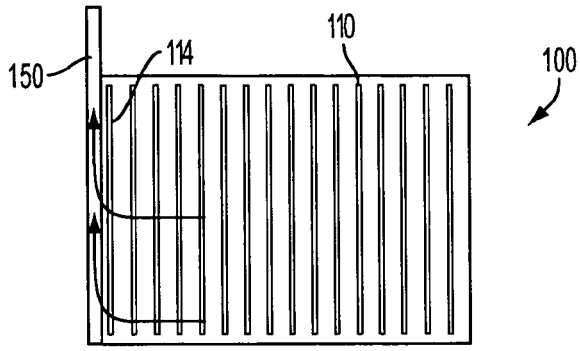
FIG. 2 illustrates a traveling wave array that may stagnate with moderate mass loading.

FIG. 2 depicts a stagnation situation with a concentrated sample of 3 μm and 6 μm diameter polystyrene beads. In the traveling wave array 100 comprising a rectilinear grid 110 and a chevron grid 150, the chevron grid 150 is relatively narrow. The beads are collected on the left edge of the grid 110 along region 114 and cannot continue to travel along the chevron grid 150 to the sample well (not shown) due to the high density of particles. The reason for the congestion is evident from FIG. 2. The transition from the rectilinear grid to the chevron grid is analogous to that of a multi-lane highway converging into a much narrower lane. The width of the rectilinear grid 110 is about 5 cm so the compression factor to 3 mm is in excess of a factor of sixteen (16). Since transport is from the bottom of the chevron grid 150 to the top (as shown in FIG. 2), the probability for congestion increases as the particulates approach the sample well. Congestion is a stagnation condition in which the abundance of particulates leads to multi-layered transport which becomes inefficient due to drop-off of the transport E fields.

To mitigate against this condition and to increase the mass flow rate (which would be useful for biomedical applications where higher concentrations would be involved), the exemplary embodiment provides several versions of improved systems of traveling wave grids. Generally, in accordance with the exemplary embodiment, a system of traveling wave grids or arrays is provided that comprise a first traveling wave grid which is typically in the form of a rectilinear grid, a second traveling wave grid, which can be in the form of either a rectilinear grid or a chevron grid, or some other type of grid, and a transition region extending between the first and second grids. As noted, the first and second grids are oriented at an angle with respect to each other. The transition region is a traveling wave grid, or portion thereof, which serves to efficiently assist in transporting particulates from one grid to another, and preferably also promotes the change in direction of the particulates.

Figure 3:
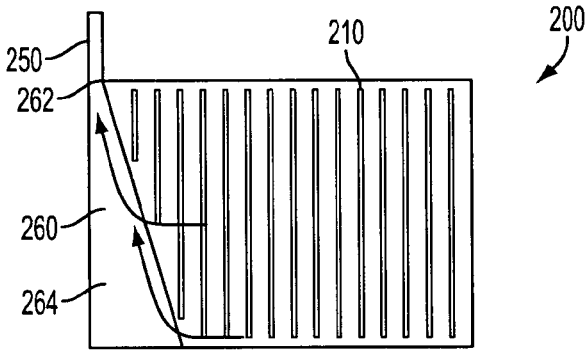
FIG. 3 is a schematic of an exemplary embodiment traveling wave array where the blank regions denote curvilinear grids for particle focusing.

Specifically, FIG. 3 illustrates a traveling wave array 200 in accordance with the exemplary embodiment comprising a rectilinear grid 210 in communication with a chevron grid 250 having an angled interface region 260. The distal end 264 of the interface region 260 has a greater area or width than the proximal end 262 of the region 260. That is, with respect to the direction of flow of particulates on the chevron grid 250, the width of the interface region 260 decreases with the direction of flow. FIG. 3 illustrates the use of a converging radial traveling wave array for the transition region 260. A characteristic of the array of FIG. 3 is an overlapping path as particles in one region of the grid 210 overlap with particles in certain regions of the chevron grid 250.

Figure 4:
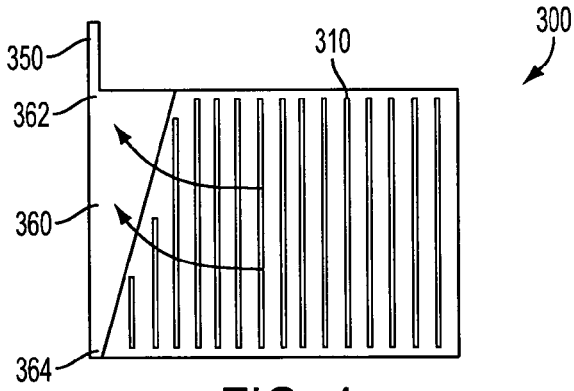
FIG. 4 is a schematic of another exemplary embodiment of a stagnation-resistant traveling wave array.

FIG. 4 depicts a traveling wave array 300 comprising a rectilinear grid 310 in communication with a chevron grid 350 having an angled interface region 360. The distal end 364 of the region 360 has a smaller area or width than the proximal end 362 of the region 360. In contrast to the configuration of FIG. 3, the array of FIG. 4 features an interface region 360 having a width that increases with the direction of flow of particulates on the chevron grid 350. In the array of FIG. 4, a converging radial traveling wave array is also depicted, however, with minimal overlapping paths. The array of FIG. 4 is particularly beneficial in that congestion is minimized and overlapping paths of traveling particles are also reduced.

Figure 5:
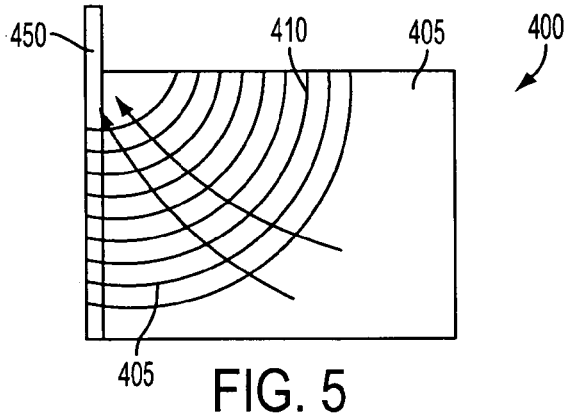
FIG. 5 is a schematic of yet another exemplary embodiment traveling wave array.

FIG. 5 illustrates another traveling wave array 400 comprising a first grid 410 that utilizes a plurality of arcuate electrodes 405, and a second grid 450 which can be in the form of a chevron grid or a rectilinear grid. In this version of the exemplary embodiment, the first grid 410 is in essence, a transition region in itself. FIG. 5 illustrates another strategy for a single converging radial traveling wave array. This array features a relatively shortly travel distance for faster concentration.

In FIGS. 3-5, the shaded area indicates the noted transition regions and can be in the form of expanded chevron grid regions emanating from the sample well inlet. All three configurations open up many lanes into the sample well. Expanding the chevron grid regions allows more gradual convergence of the particle streams over a larger approach angle span.

The exemplary embodiment also provides strategies for particle separation. Most particulates have a native charge dependent on pH which leads to a Coulomb force, but may also polarize in a non-uniform field. The induced dipole moment (Clausius-Mossofti) is:

$$p=4\pi a^3\in_o(\in-1)/(\in+2)E;\ \in=\in_{particle}/\in_{fluid}$$

where a is the particle radius, $\in_{particle}$ is the particle dielectric constant, and $\in_{fluid}$ is the fluid dielectric constant. For low frequencies, $\in$ is real. The dipole force is given by:

$$F_{dipole}=(p\cdot\nabla)E$$

Experiments on both *Bacillus thuringiensis* spores and polystyrene beads in the 200 nm to 10 μm size range show that electro-kinetic transport is a balance of electro-osmotic flow (EOF), electrophoresis, and dielectrophoresis effects.

In one aspect, the exemplary embodiment separates particles by varying the traveling wave sweep frequency. The characteristic transport of traveling waves is synchronous below a threshold sweep frequency and an asynchronous mode above that. The distinction is the balance of Coulomb and dielectrophoretic forces against drag whereby some particles are able to keep up and others are not. This trait is retained for a fluidic environment, especially for larger and more dipolar particles. A sample mixture of 1 μm, 3 μm, and 6 μm polystyrene beads demonstrates that at 3 Hz, all beads in the size range are transported. At 4 Hz, some larger beads are stagnated by being trapped at traces. The reason is that their displacement is shorter than the pitch of the traveling wave array so that they are trapped in a situation where they move back and forth between the traces. At 6 Hz, all beads are trapped. This frequency sensitivity may be exploited in a separation method. The strategy is to scan down in frequency to selectively move the more mobile particles out of the mixture in sequential fashion.

Figure 6:
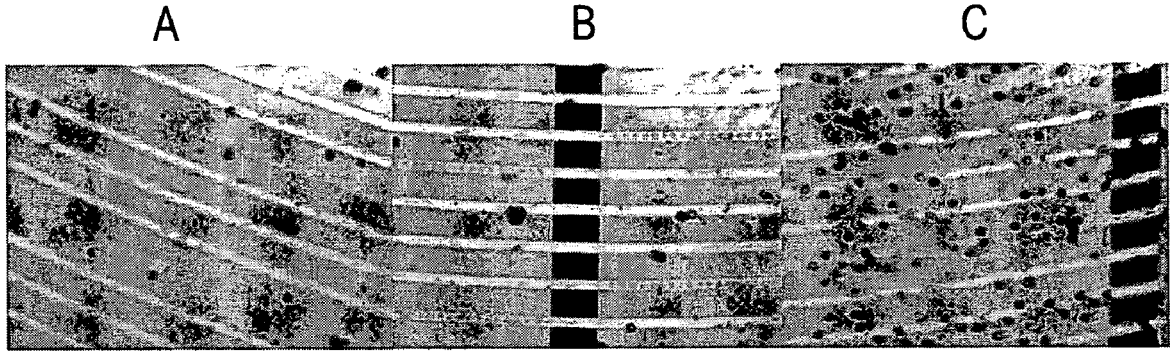
FIG. 6 is a collection of three micrographs spanning the width of a curvilinear traveling wave grid showing the degree of curvature and resultant focusing in a stream of differently sized particulates undergoing a change in direction in accordance with the exemplary embodiment.

In another aspect, the exemplary embodiment separates particles by bending or turning a particle stream around a corner. Specifically, this mode of separation involves moving the particle stream around a corner where the traveling wave grids transition such that the fields also reflect a change in direction. This strategy is motivated by the observation that when particles of various sizes concentrate into a sample well, they appear to have different turning radii depending on their relative size. FIG. 6 shows three micrographs A, B, and C spanning the width of a chevron grid region. The results are for a sample mixture of 1 μm, 3 μm and 6 μm polystyrene beads. The 6 μm beads take a tighter turn around the corner as is evident from the micrograph C. The smaller 1 μm and 3 μm beads take a wider turn as depicted in micrographs A and B. The reason is that the dielectrophoretic force scales with volume ($r^3$) so larger beads experience immediate effects of the turning field and are able to turn faster.

Figure 7:
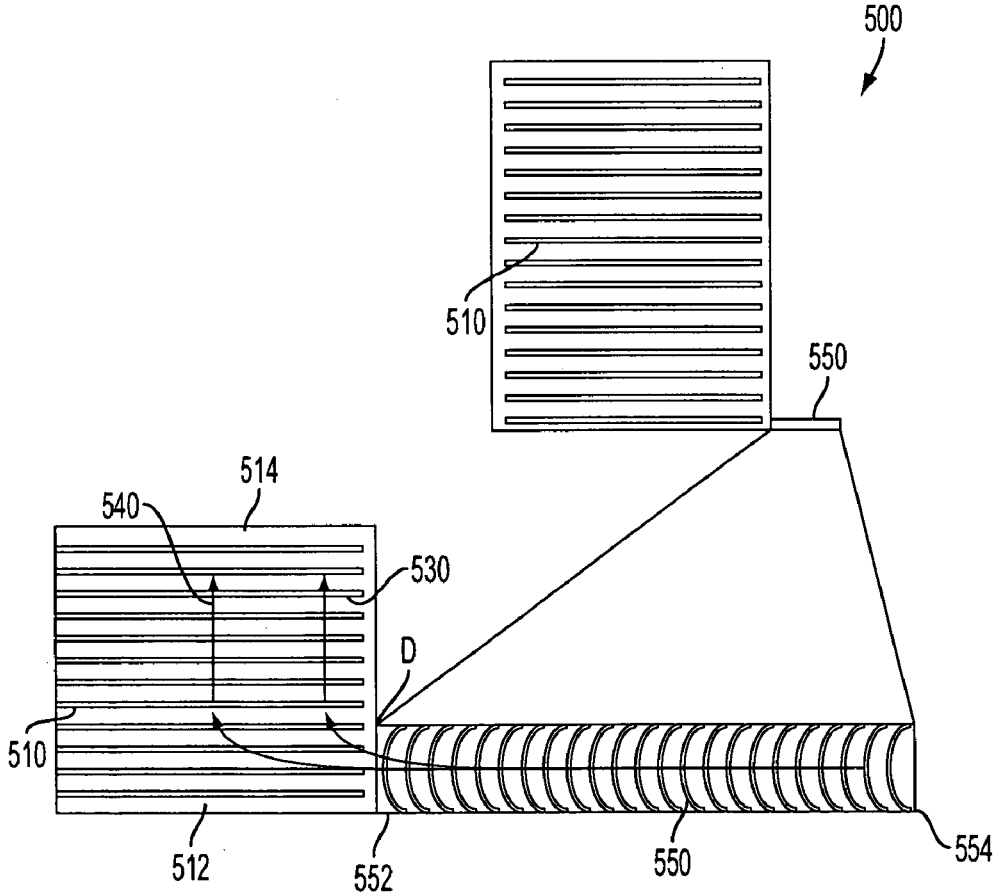
FIG. 7 is a schematic of another exemplary embodiment traveling wave array showing separation of the focused particle stream.

Referring to FIG. 7, a traveling wave grid 500 in accordance with the exemplary embodiment was utilized to further investigate and implement this phenomenon. The array 500 comprises a chevron grid 550 and a rectilinear grid 510. A way to test the separation capability, albeit only an approximation, using the exemplary embodiment separation strategy is to operate the array 500 in reverse. A 100 μL volume of concentrated mixture of 1, 3 and 6 μm particles is introduced into the sample well at a first end 554 of the chevron grid 550 and the traveling wave grids 510 and 550 are operated in reverse to move the sample out into the main rectilinear grid 510. Specifically, the particulates are transported from the first end 554 to a second end 552 of the chevron grid, and then from or near a first end or region 512 of the rectilinear grid 510 to a second end or region 514 of that grid 510. The path of the larger 6 μm particles is denoted by arrow 530. The path of the smaller 3 μm particles is denoted by arrow 540. The particles that change direction are generally larger in size than particles that undergo the same change in direction but along a longer distance. The particle mixture in the relatively narrow channel of the chevron grid 550 is transported and focused by the radial traveling wave array, i.e. the chevron grid 550, and injected into a separation cavity with a linear traveling wave array, i.e. the rectilinear grid 510 moving particles upward. The relatively smaller beads or particles such as the 3 μm size beads move faster and arrive first. The larger 6 μm beads or particles move slower and can react to directional change in a shorter distance in sweeping around the corner such as denoted by D.

Figure 8:
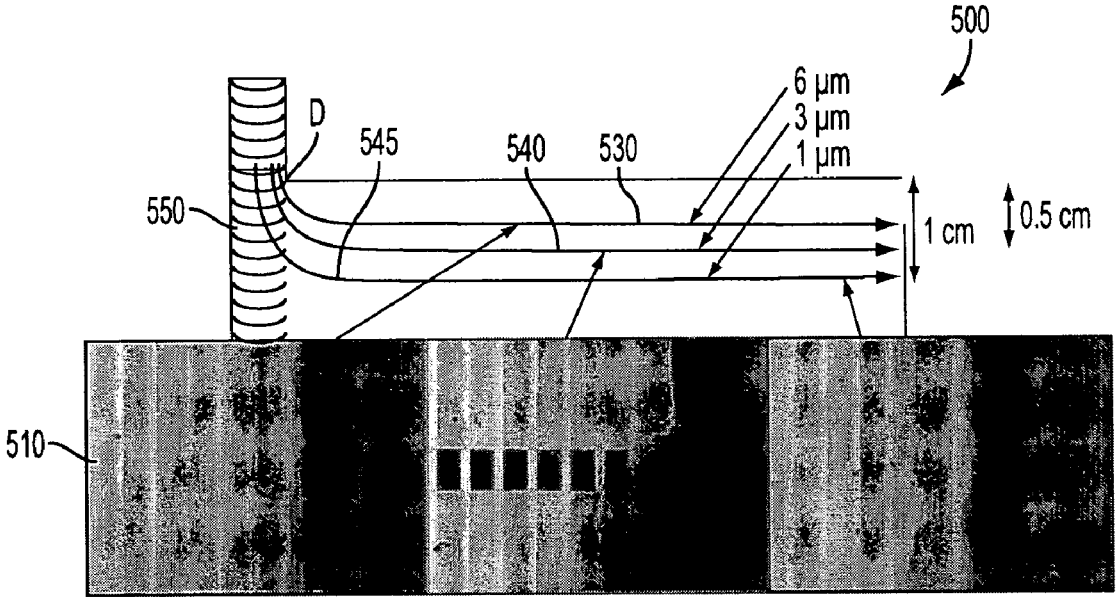
FIG. 8 illustrates a separation strategy in accordance with the exemplary embodiment.

FIG. 8 shows the results of this trial where the 1, 3, and 6 μm beads are distributed over a 1 cm wide swath. Specifically, the path of the 6 μm particles is noted by arrow 530. The path of the 3 μm particles is noted by the arrow 540. And, the path of the 1 μm particles is noted by the arrow 545. It is significant to note that both the paths of 6 μm and 3 μm particles underwent a 90° change in direction around corner D, within a 0.5 cm span. This result is impressive considering that the chevrons are facing a direction such that they tend to be dispersive rather than focusing. The low sample density in the rectilinear chamber also requires microscopy to visualize the sample separation.

Figure 9:
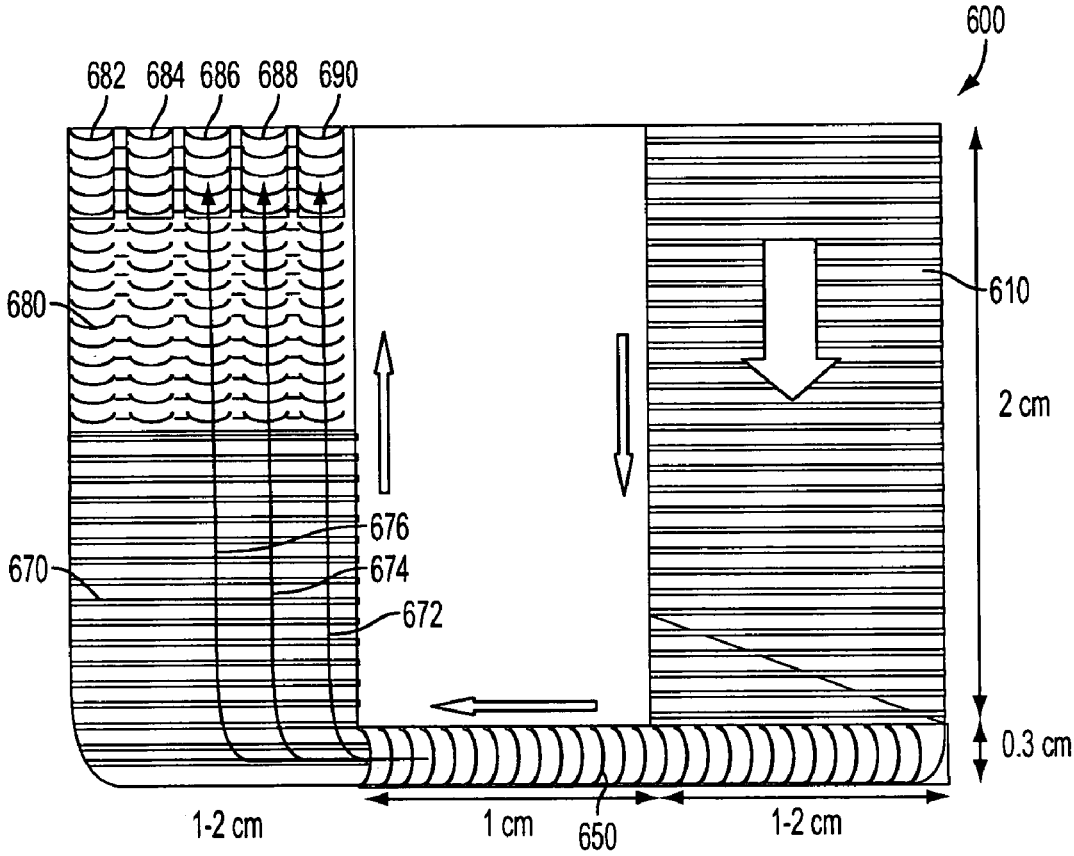
FIG. 9 is a schematic of a purification cell in accordance with the exemplary embodiment.

The exemplary embodiment also provides a purification cell. The combination of the noted traveling wave grid layouts and sample separation strategies may be incorporated together with the concentration and focusing aspects of the device to provide a purification cell 600 as shown in FIG. 9. The purification cell 600 includes a concentration chamber 610, a focusing channel 650, and a separation chamber 670, 680. The top 680 of the separation chamber may be divided into a lateral row of compartments 682, 684, 686, 688, and 690 to collect an increasing range of particle sizes proceeding from left to right. For example, relatively large sized particles constitute the stream denoted by arrow 672, which are subsequently collected in compartment 690. Intermediate sized particles constitute the stream denoted by arrow 674, which are subsequently collected in compartment 688. And relatively small sized particles in stream 676 are collected in compartment 686. Streams of finer sized particles can be collected in one or both of the compartments 682 and 684. The traveling wave arrays in the separation chamber may be a continuous layout of chevrons to focus particulates in the different size ranges into the designated collection compartments at the top. The focusing section 650 forms a narrow stream which will result in improved separation performance. Representative dimensions for each portion or component of the cell 600 are provided on FIG. 9.

Figure 10:
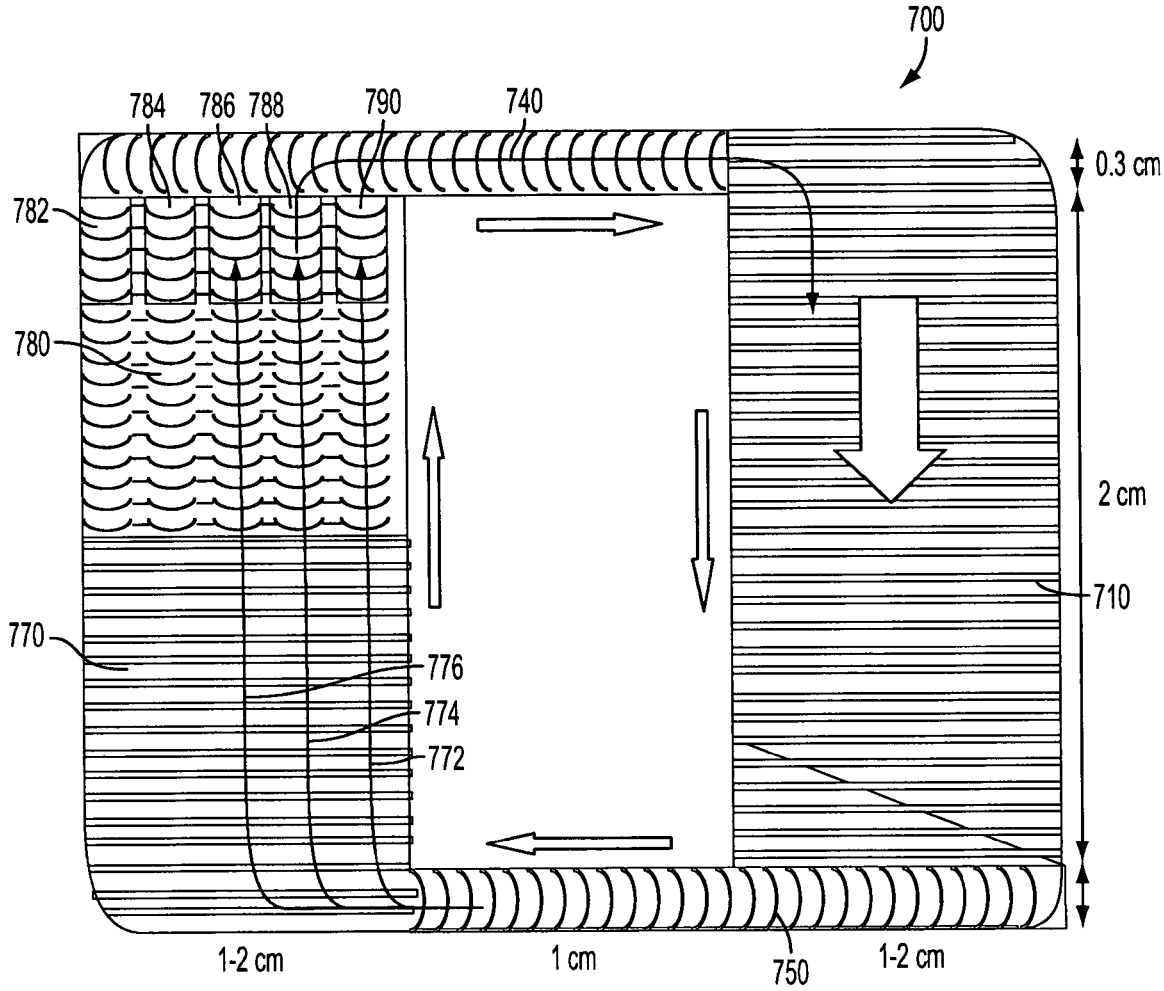
FIG. 10 is a schematic of another recirculating purification cell in accordance with the exemplary embodiment.

FIG. 10 shows another exemplary embodiment traveling wave array 700 where a connecting bridge is utilized and disposed between the top to close the loop on the cell. This strategy allows the contents of one of the collected compartments to be re-circulated to result in increased purification. The purification cell 700 includes a concentration chamber 710, a focusing channel 750, a separation chamber 770, 780, and a connecting bridge 740. The top of the separation chamber may be divided into a collection of compartments 782, 784, 786, 788, and 790 to collect an increasing range of particle sizes proceeding from left to right. For example, relatively large size particles constitute the stream denoted by arrow 772, which are subsequently collected in compartment 790. Intermediate sized particles constitute the stream denoted by arrow 774, which are subsequently collected in compartment 788. And relatively smaller sized particles in stream 776 are collected in compartment 786. Streams of finer sized particles can be collected in one or both of compartments 784 and 782. The connecting bridge 740 can be utilized to selectively return particles of a particular size or size range, to the concentration chamber 710 if further processing is desired.

Figure 11:
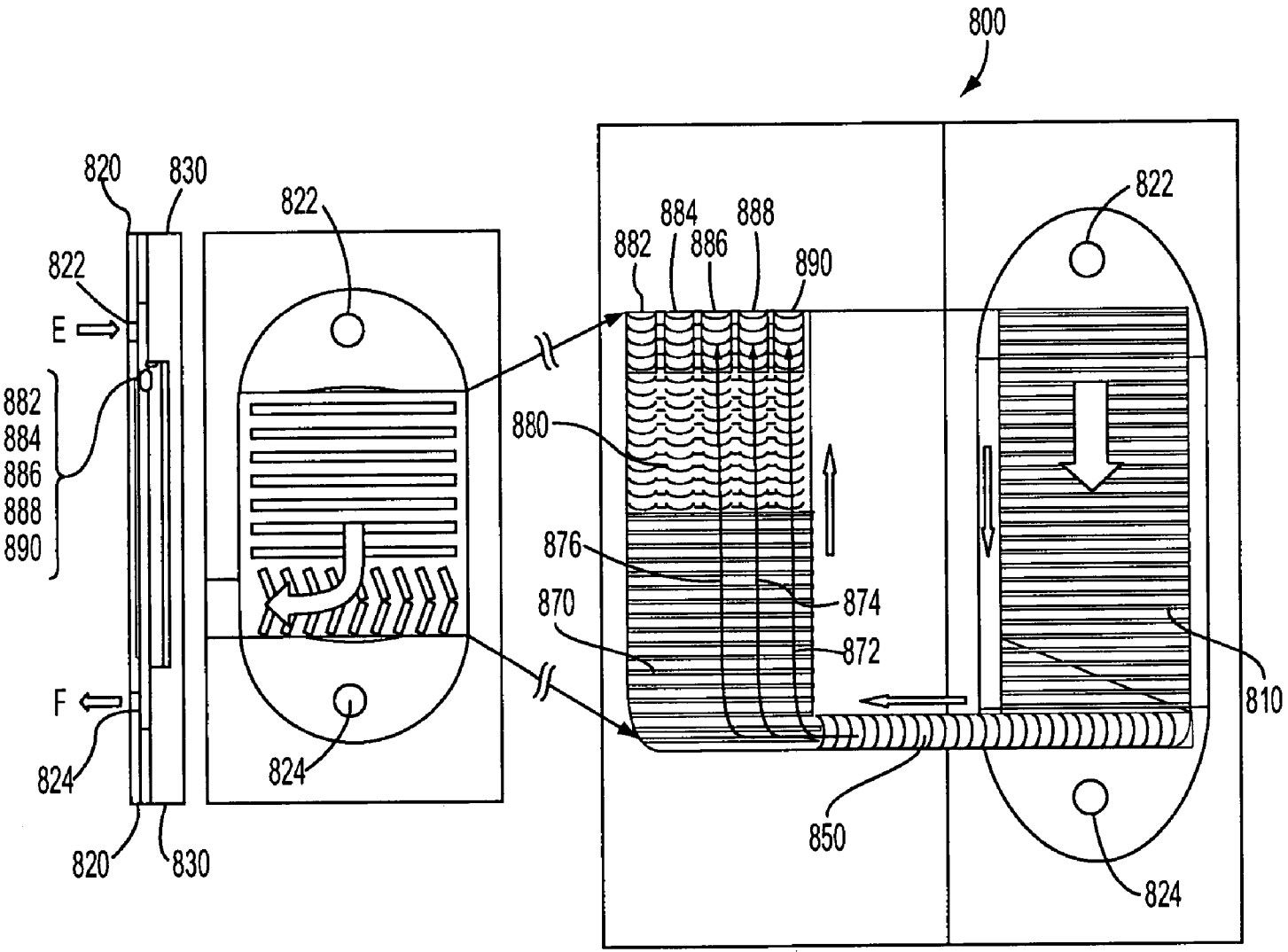
FIG. 11 is a schematic of a purification device integrated with a modified field flow fractionation cell for continuous separation in accordance with the exemplary embodiment.

For large sample volumes, the exemplary embodiment purification cell may be incorporated into the mFFF cell geometry as shown in FIG. 11. Specifically, the cell 800 comprises a concentration chamber 810, upper and lower regions 880 and 870 of a separation chamber, and a focusing channel 850 extending between the concentration chamber 810 and the lower region 870 of the separation chamber. The upper region 880 of the chamber, includes a collection of compartments for retaining particles of different sizes, as described in conjunction with FIGS. 9 and 10. Specifically, the cell 800 includes two spaced apart substrates or plates 820 and 830, one of which defines an inlet 822 for an inlet stream E, and an outlet 824 for an outlet stream F. As previously described with the configurations of FIGS. 9 and 10, the upper region 880 of the separation chamber includes a plurality of compartments 882, 884, 886, 888, and 890 for collecting particles of different sizes or size ranges. The operation of the purification cell is as follows. A sample stream E enters the cell 800 via inlet 822. The entering sample flows into the concentration chamber 810. A compression field moves particulates downward to the near vicinity of the lower surface where the traveling wave grid disposed therein transports the stream and components therein, toward the focusing channel 850. Once the sample is in the channel 850, the chevron traveling wave grid extending therein, transports and directs the sample to the noted separation chamber. The orientation of the separation chamber is generally transverse to the direction of flow of the sample in the focusing channel 850. As the stream enters the lower region 870 of the separation chamber, as previously described, the particulates separate into discrete streams 872, 874, and 876. The largest particles collect in compartment 890. Smaller sized particles collect in the other compartments. The remaining portion of the stream exits the cell 800 at outlet 824 as stream F.

The various purification cells of the exemplary embodiment can employ cascaded functions of concentration, focusing, and separation. The cells can feature a constant volume design, a flow-through configuration with increasing volume, or utilize a constant volume with a recirculating transport to achieve higher purity concentrations.

The advantages of the exemplary embodiment include but are not limited to new traveling wave grid configurations to increase mass flow and to minimize congestion and stagnation; the provision of new strategies for separation; and the provision of a purification cell which can handle tens of milliliters as compared to existing methods which are complicated and only handle up to several hundred microliters.

Potential applications of the exemplary embodiment include but are not limited to pre-concentrators for front-end detection in bio-defense applications; water supply monitoring for utilities; food toxicology; blood plasma separation; cell enrichment; and protein purification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A traveling wave grid system comprising:

a first traveling wave grid comprising a plurality of electrodes;

a second traveling wave grid downstream of the first grid comprising a plurality of electrodes;

a transition region extending between the first and second traveling wave grids and including a plurality of arcuate traces, the transition region adapted to transport and cause convergence of a particle stream from the first grid to the second grid.

2. The traveling wave grid system of claim 1 wherein the first traveling wave grid and the second traveling wave grid are oriented at an angle of from about 10° to about 170° with respect to each other.

3. The traveling wave grid system of claim 2 wherein the first and second grids are oriented at an angle of from about 45° to about 135° with respect to each other.

4. The traveling wave grid system of claim 3 wherein the first and second grids are oriented at an angle of about 90° with respect to each other.

5. The traveling wave grid system of claim 1 wherein the second traveling wave grid is a chevron grid.

6. The traveling wave grid system of claim 1 wherein the transition region decreases in width as the region extends to the second traveling wave grid.

7. The traveling wave grid system of claim 1 wherein the transition region increases in width as the region extends to the second traveling wave grid.

8. The traveling wave grid system of claim 1 wherein the transition region includes chevron traveling wave grids.

9. A method for differentiating particles according to size from a sample of particles, the method comprising:

providing a traveling wave grid system including a first traveling wave grid comprising a plurality of electrodes and a second traveling wave grid comprising a plurality of electrodes, the first and second traveling wave grids being oriented at an angle with respect to each other, the angle ranging from about 10° to about 170°;

introducing a sample containing particles of different sizes onto the first traveling wave grid;

operating the traveling wave grid system to thereby transport the particles along the first and second traveling wave grids, whereby upon undergoing a change in direction corresponding to the angled orientation of the first and second traveling wave grids, the particles separate into at least two groups, according to the size of the particles.

10. The method of claim 9 wherein the first traveling wave grid and the second traveling wave grid are oriented at an angle of from about 45° to about 135° with respect to each other.

11. The method of claim 10 wherein the first and second grids are oriented at an angle of about 90° with respect to each other.

12. The method of claim 9 wherein particles undergo the change in direction along a longer distance than other particles, are smaller in size than the other particles.

13. The method of claim 9 wherein larger particles have shorter turning radii than smaller particles.

14. A method for differentiating particles according to size from a sample of particles, the method comprising:

providing a traveling wave grid comprising a plurality of electrodes and including a provision for selectively adjusting a sweep frequency of an electrical voltage signal applied to the grid;

introducing a sample containing particles of different sizes on the traveling wave grid;

operating the grid at a first sweep frequency whereby particles of a first size are displaced from one region of the grid to another; and operating the grid at a second sweep frequency, different than the first sweep frequency whereby particles of a second size, different than the first size, are displaced from one region of the grid to another.

15. The method of claim 14 wherein the first sweep frequency is higher than the second sweep frequency.

16. The method of claim 15 wherein the particles displaced from use of the first sweep frequency are smaller than the particles displaced from use of the second sweep frequency.

17. A purification cell adapted to remove and classify particles from a sample, the cell comprising:

a concentration chamber including a first traveling wave grid comprising a plurality of electrodes;

a separation chamber including a second traveling wave grid comprising a plurality of electrodes;

a focusing channel extending between the first and second traveling wave grids, and including a third traveling wave grid, the second and third traveling wave grids being oriented at an angle of from about 10° to about 170° with respect to each other;

the separation chamber further including a plurality of compartments adapted to receive particles of different sizes, wherein the plurality of compartments are aligned across the second traveling wave grid.

18. The purification cell of claim 17 wherein the third traveling wave grid is a chevron traveling wave grid.

19. The purification cell of claim 17 wherein the separation chamber includes one or more chevron traveling wave grids.

20. The purification cell of claim 19 wherein the number of chevron traveling wave grids corresponds to the number of compartments.

21. The purification cell of claim 17 wherein the compartment nearest the focusing channel receives particles of the largest size within the sample upon operation of the cell.

22. The purification cell of claim 17 further comprising:

a recirculation loop extending between the concentration chamber and the separation chamber, the recirculation loop including a fourth traveling wave grid.

* * * * *